US008967769B1

(12) United States Patent
Dowell

(10) Patent No.: US 8,967,769 B1
(45) Date of Patent: Mar. 3, 2015

(54) PRINT BAR STRUCTURE

(71) Applicant: Hewlett-Packard Development Company, L.P., Houston, TX (US)

(72) Inventor: Daniel D. Dowell, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/010,861

(22) Filed: Aug. 27, 2013

(51) Int. Cl.
*B41J 2/15* (2006.01)
*B41J 2/145* (2006.01)

(52) U.S. Cl.
CPC ..... *B41J 2/145* (2013.01)
USPC ..... 347/40

(58) Field of Classification Search
CPC ..... B41J 2/155; B41J 2202/20; B41J 2/145; B41J 2202/19; B41J 2/1631
See application file for complete search history.

(56) References Cited

U.S. PATENT DOCUMENTS

| | | | | |
|---|---|---|---|---|
| 5,160,945 | A | 11/1992 | Drake | |
| 5,808,635 | A | 9/1998 | Kneezel et al. | |
| 6,070,965 | A | 6/2000 | Fujimoto | |
| 6,123,410 | A | 9/2000 | Beerling et al. | |
| 6,343,857 | B1 | 2/2002 | Cowger | |
| 6,431,683 | B1 | 8/2002 | Ho et al. | |
| 6,557,976 | B2 | 5/2003 | McElfresh et al. | |
| 6,869,166 | B2 | 3/2005 | Brugue et al. | |
| 8,205,965 | B2 | 6/2012 | Scheffelin et al. | |
| 2012/0019593 | A1 * | 1/2012 | Scheffelin et al. | 347/40 |
| 2013/0106954 | A1 | 5/2013 | Choy et al. | |

* cited by examiner

*Primary Examiner* — Lisa M Solomon
(74) *Attorney, Agent, or Firm* — Hewlett-Packard Patent Department

(57) ABSTRACT

In one example, a print bar structure includes: a planar, rigid first part; an elongated second part having a front face on which one or more printheads may be mounted and a rear face opposite the front face; and an elongated third part having a front face. The second part and the third part are affixed to one another but not to the first part with the first part sandwiched tightly between the rear face of the second part and the front face of the third part such that the rear face of the second part and the front face of the third part conform to the planar shape of the first part.

15 Claims, 9 Drawing Sheets

PRINT BAR STRUCTURE

BACKGROUND

In some inkjet printers, a media wide arrangement of stationary printheads is used to print on paper or other print media moved past the printheads. In one type of print bar for less expensive media wide inkjet printers for personal and small business users, long narrow molded plastic parts support and carry ink to the printheads.

DRAWINGS

Figure 5:
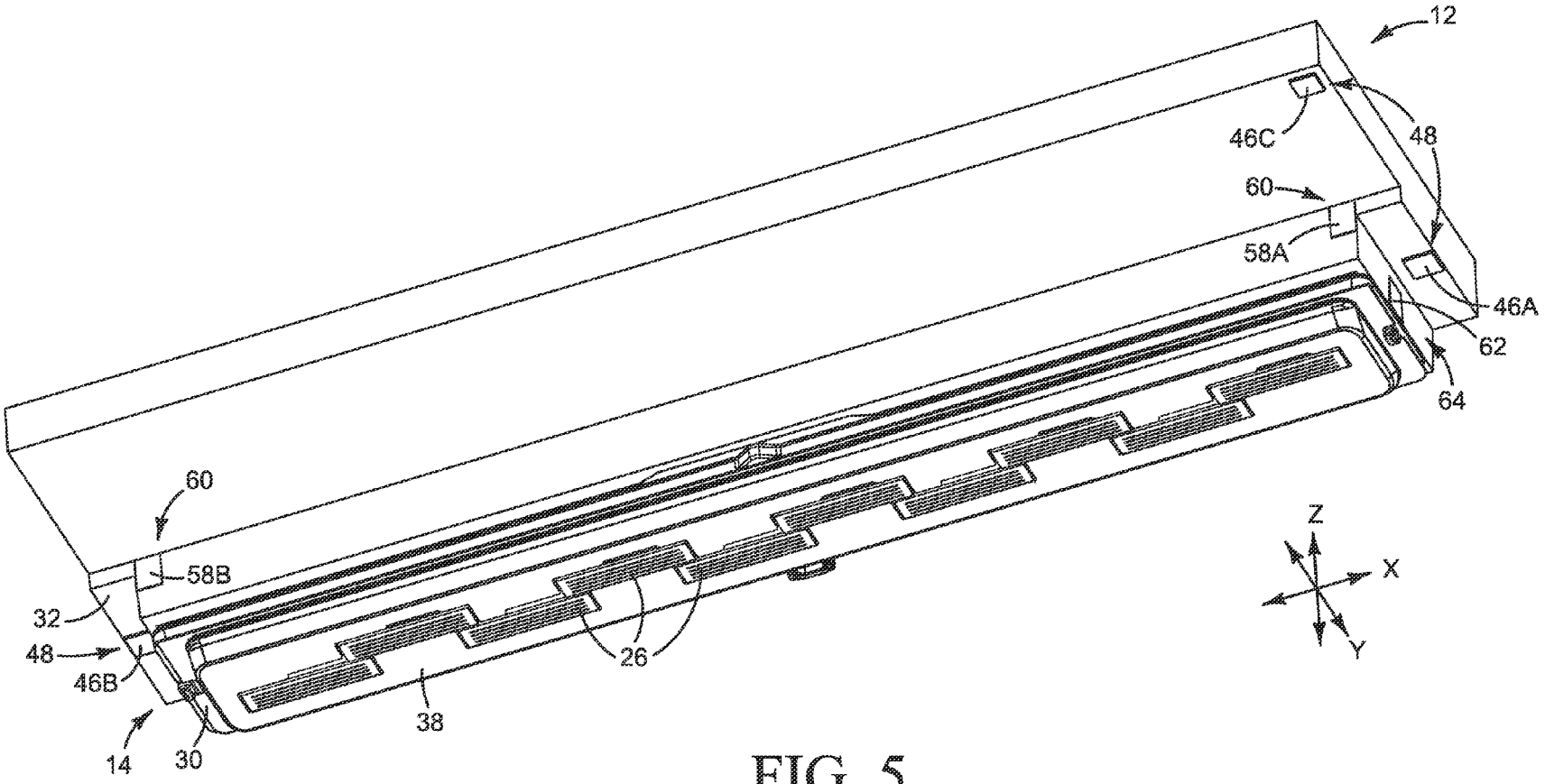
FIG. 5 is a perspective view of a print bar implementing one example of the new print bar structure viewed looking toward the exposed printheads, which is typically the bottom of the print bar when the print bar is installed in a printer.
Figure 6:
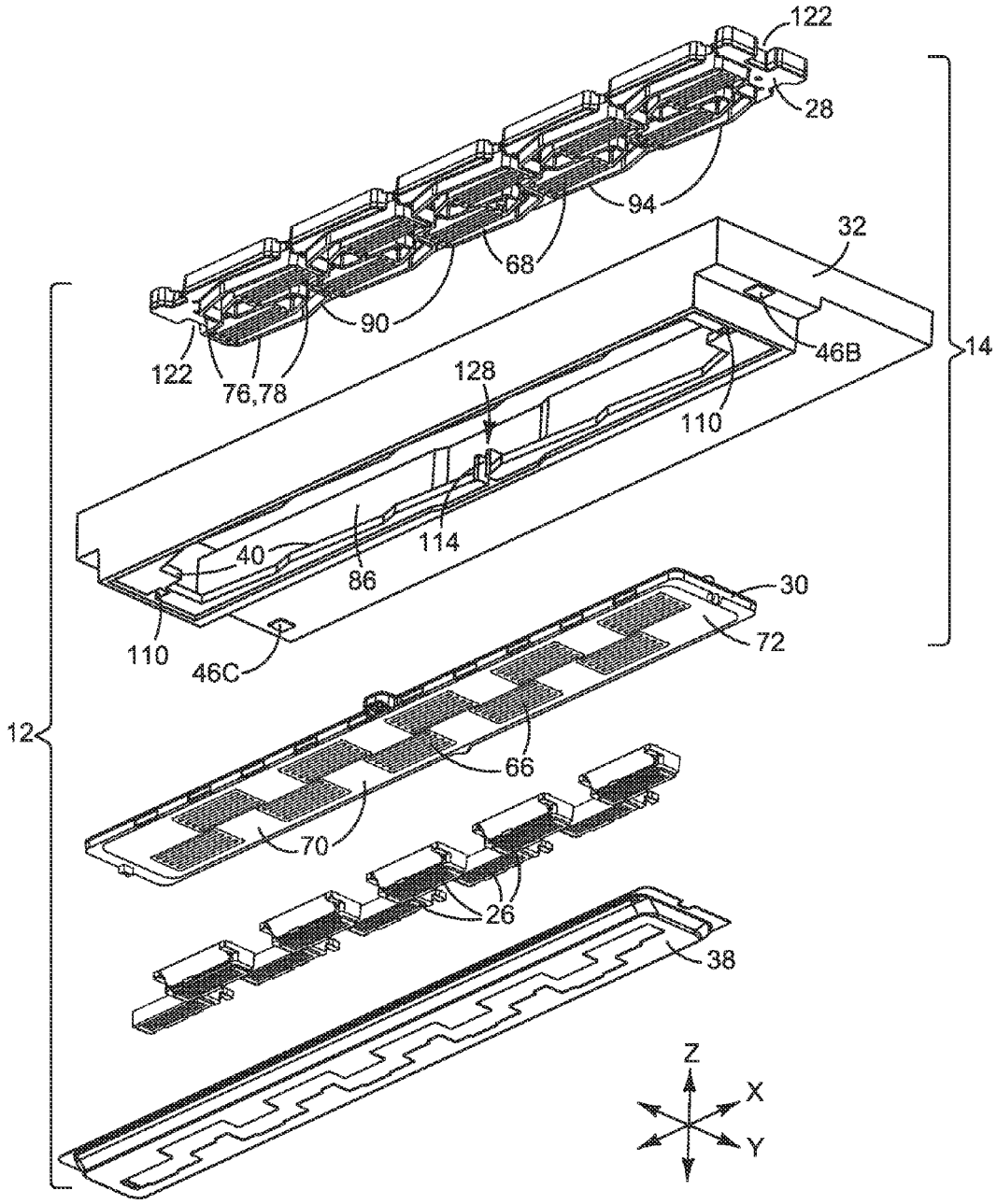
FIGS. 6 and 7 are exploded views of the print bar of FIG. 5.
Figure 7:
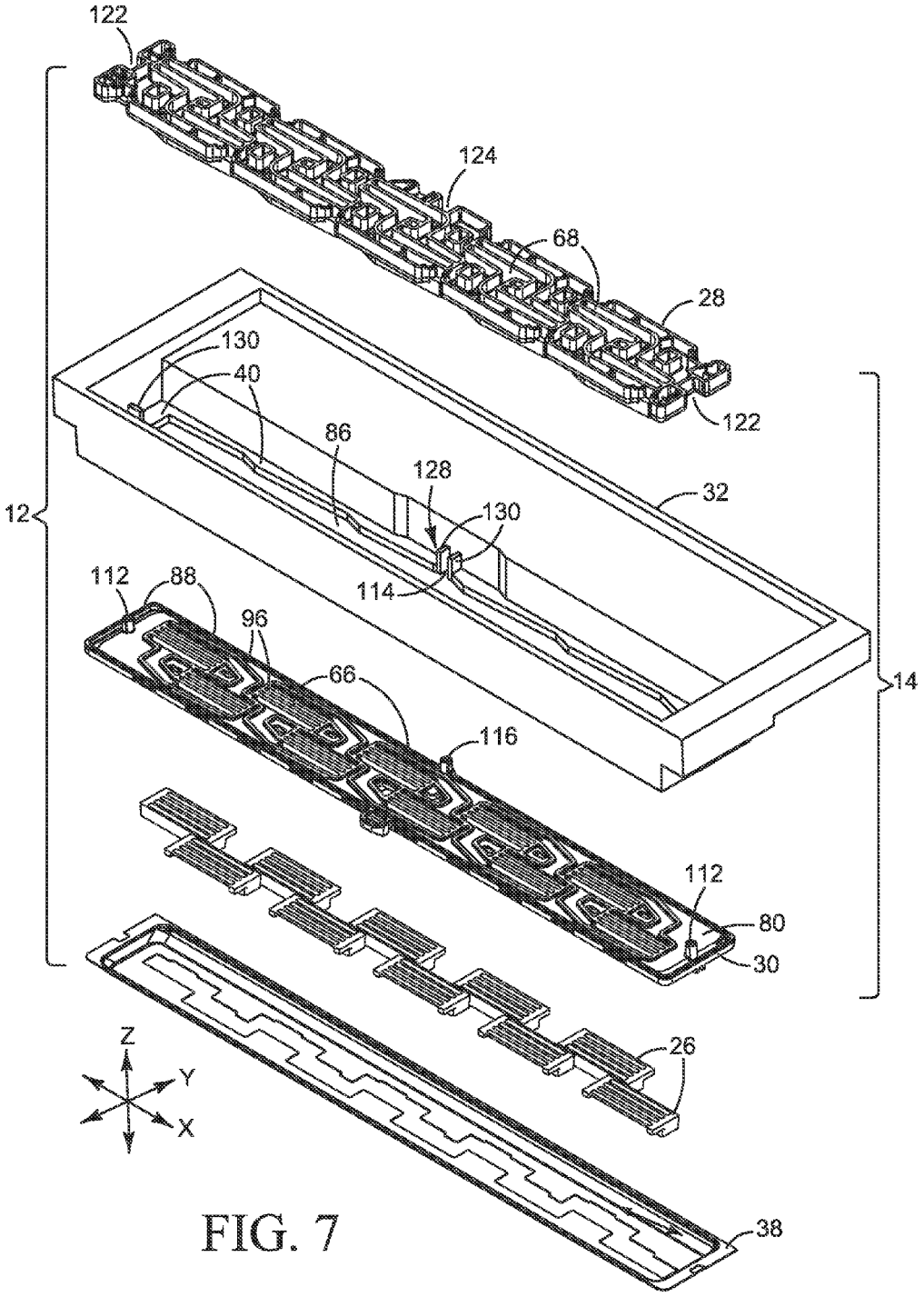
Figure 8:
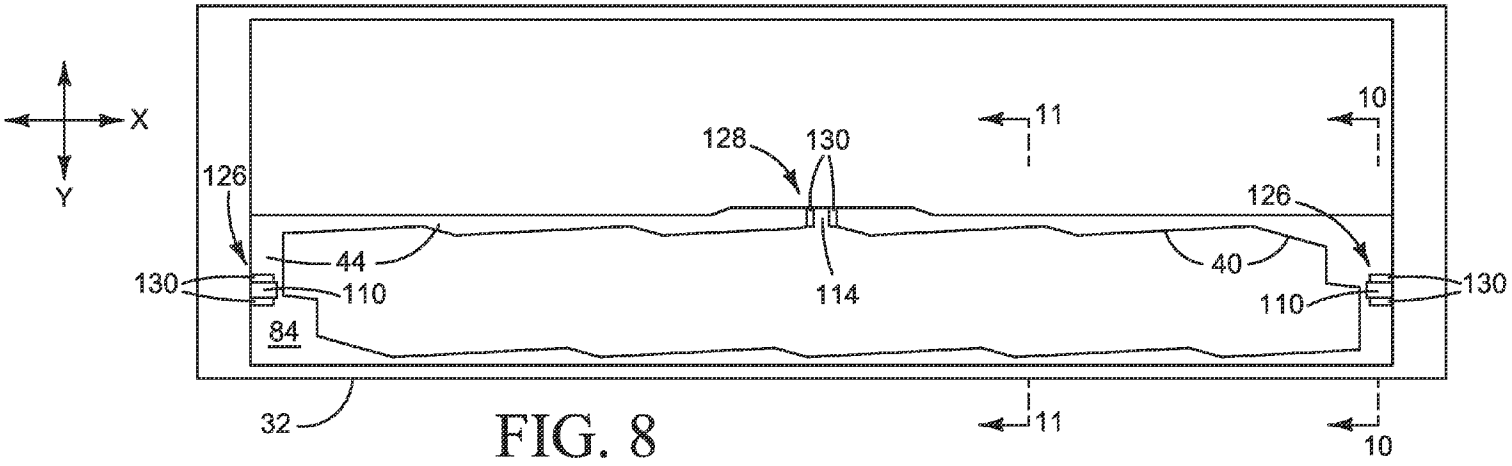
FIGS. 8 and 9 are top and bottom plan views, respectively, of the chassis from the print bar structure in the print bar of FIGS. 5-7.
Figure 9:
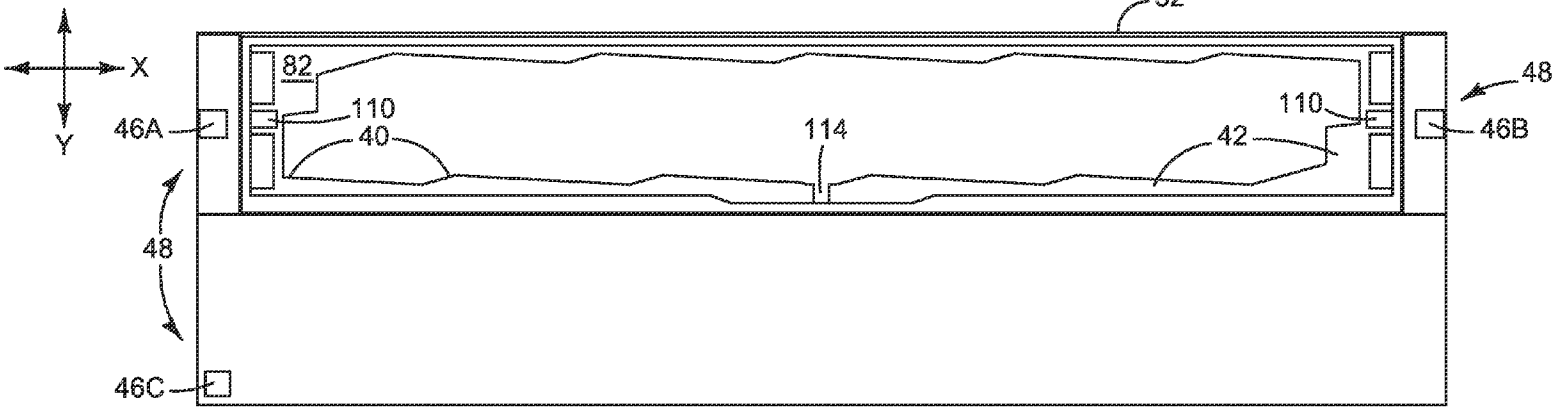
Figure 10:
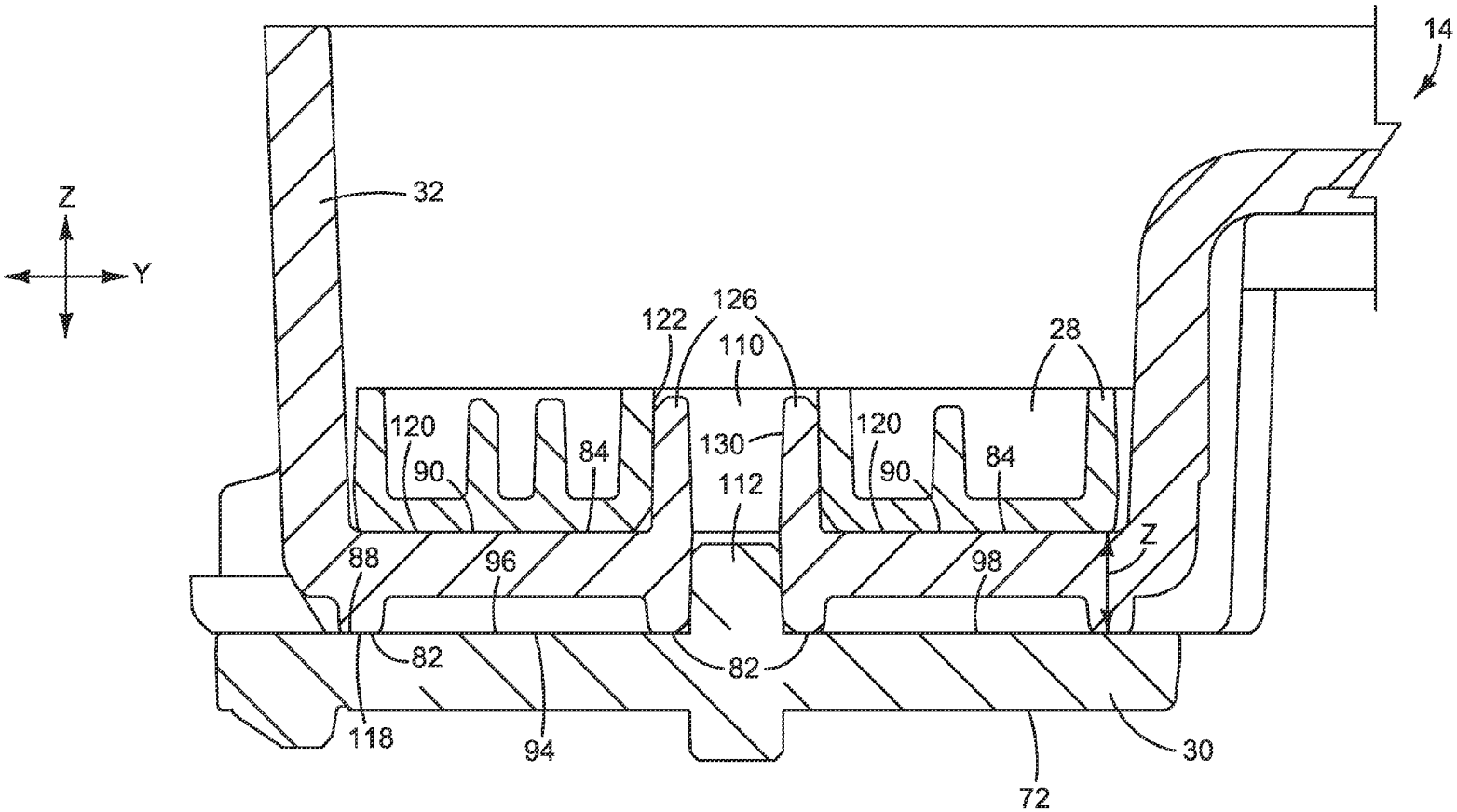
Figure 11:
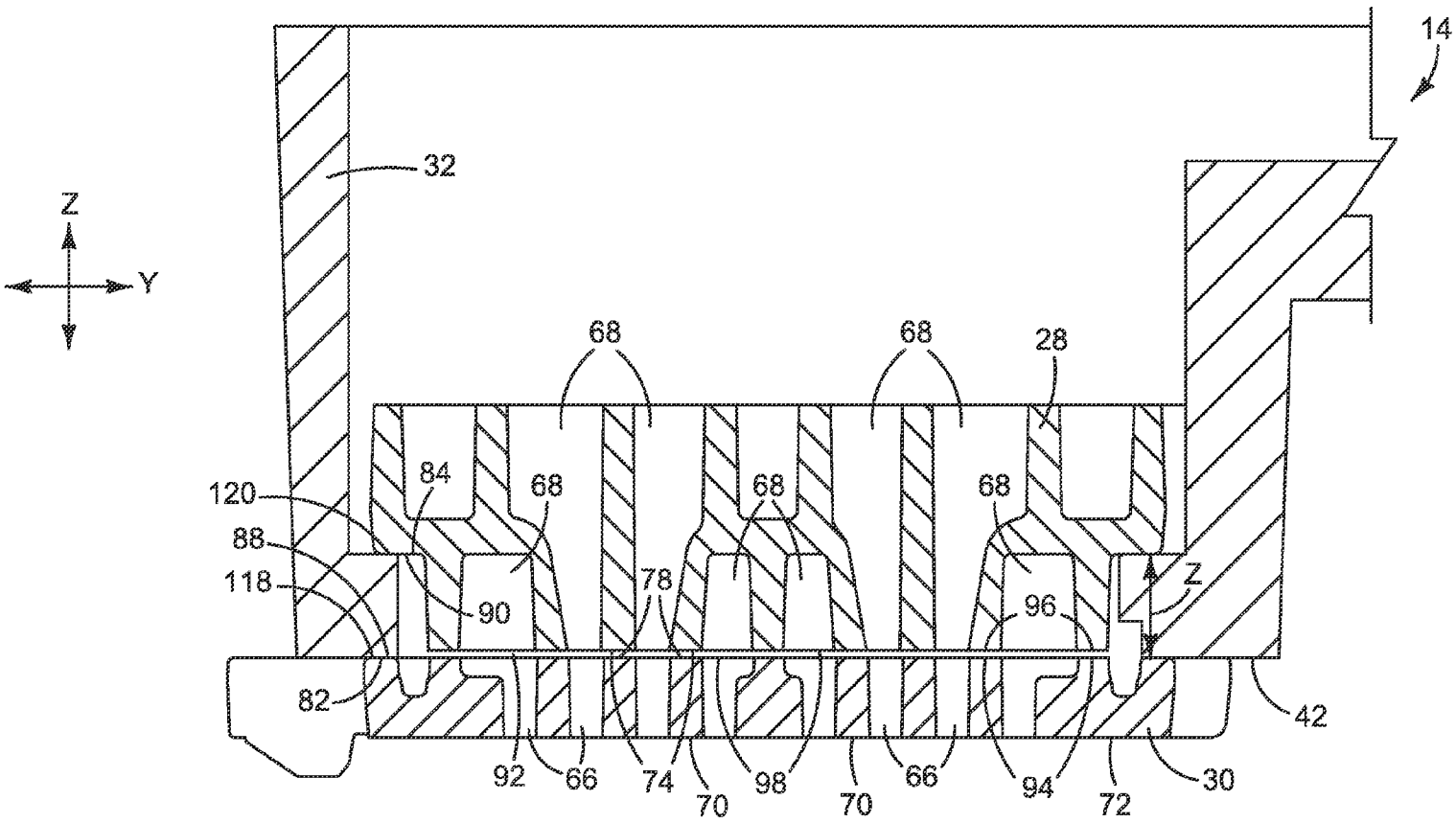

FIGS. 10 and 11 are section views of the print bar structure in the print bar of FIGS. 5-7 taken along the lines 10-10 and 11-11, respectively, in FIG. 8.

The same part numbers are used to designate the same or similar parts throughout the figures.

DESCRIPTION

One of the challenges making print bars for less expensive media wide inkjet printers that use molded plastic parts is precisely controlling the position of the printheads on the print bar to maintain the desired spacing and alignment between the printheads and the print media during printing. The length of the print bar corresponds to the width of the print media. Controlling the dimensions of and between plastic parts is more difficult in longer parts. Dimensional control includes not only the initial accuracy of a part for size, position and flatness but also the changes that occur in or between parts during use and over time.

A new print bar structure has been developed to help improve dimensional control in a page wide print bar by introducing a rigid chassis to support and constrain the molded plastic parts that make up other parts of the structure. The chassis is made from die-cast aluminum or another suitably rigid material and serves as a "backbone" for the lower cost plastic parts. Select areas of the chassis may be machined as necessary or desirable to improve dimensional attributes such as size, position, flatness, parallelism, and perpendicularity. The mechanical properties of the aluminum along with the geometry of the chassis enable a part that can span the width of the printed page while maintaining the dimensional stability needed for the print bar. Other parts in the print bar may be mounted to the chassis directly or indirectly to take advantage of its solid structural foundation, enabling the use of lower cost materials and assembly techniques.

This and other examples shown in the figures and described herein are non-limiting examples. Other examples are possible and nothing in this Description should be construed to limit the scope of the invention which is defined in the Claims that follow the Description.

As used in this document, "elongated" means a part is longer than it is wide; and a "printhead" means that part of an inkjet printer or other type of inkjet dispenser that expels fluid from one or more openings. "Printhead" and "print bar" are not limited to printing with ink but also include inkjet type dispensing of other fluids and/or for uses other than printing.

Figure 1:
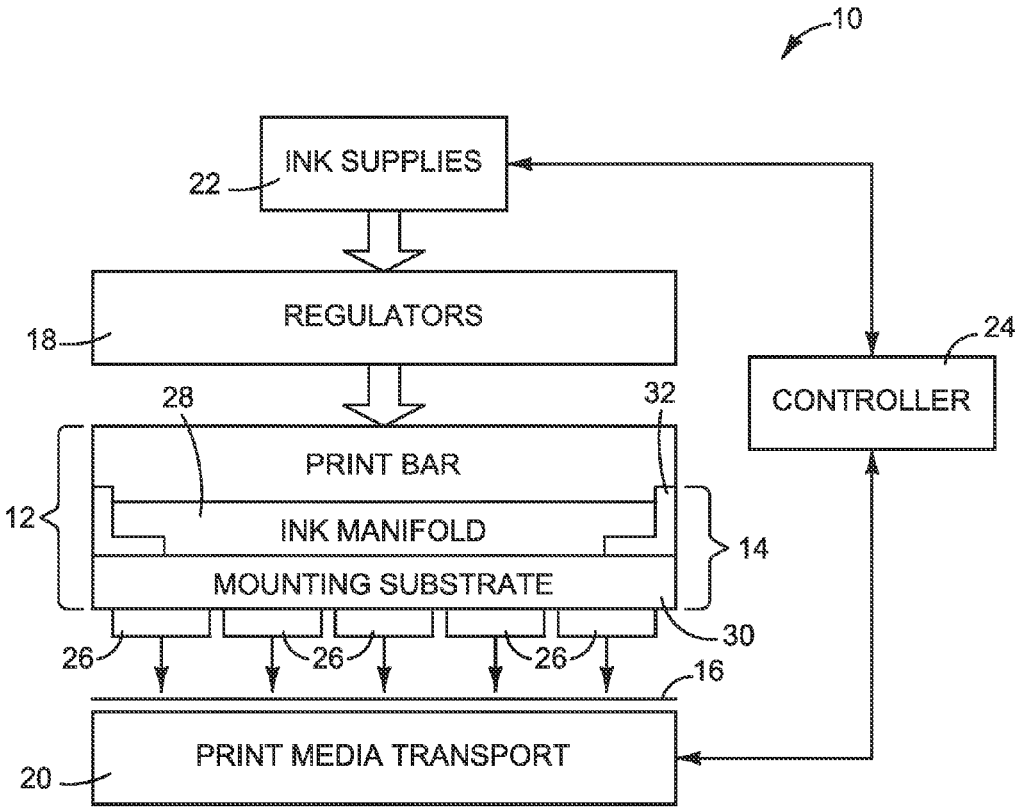
FIG. 1 is a block diagram illustrating an inkjet printer implementing one example of a new print bar structure.
Figure 2:
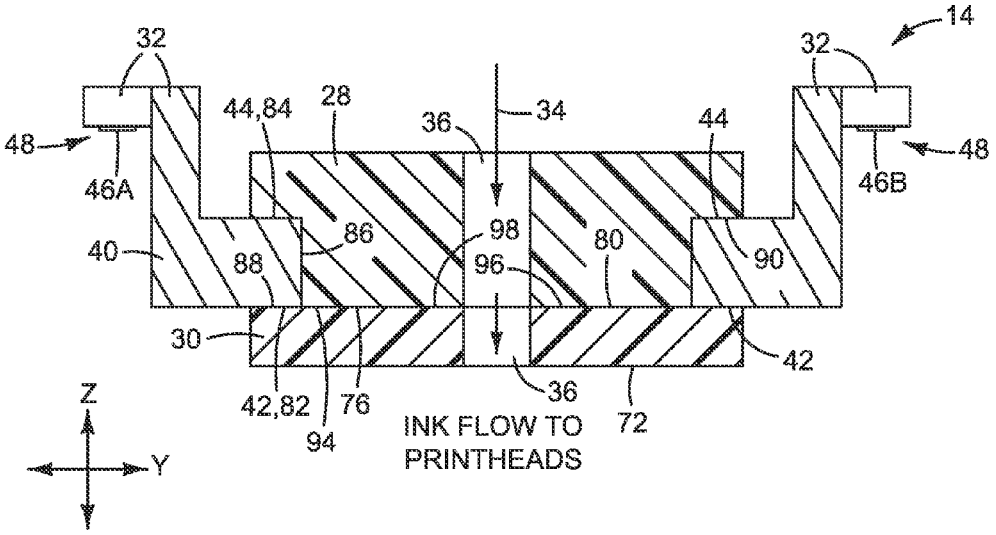
FIG. 2 is a diagrammatic partial section view illustrating a print bar structure such as the one shown in the block diagram of FIG. 1.
Figure 3:
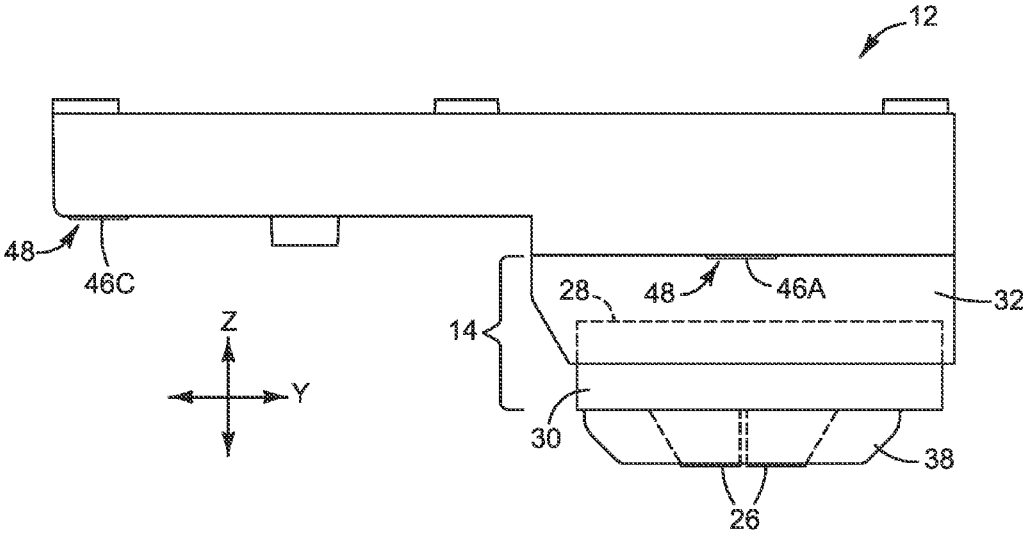
FIG. 3 is an end view of a print bar implementing the print bar structure shown in FIG. 2.
Figure 4:
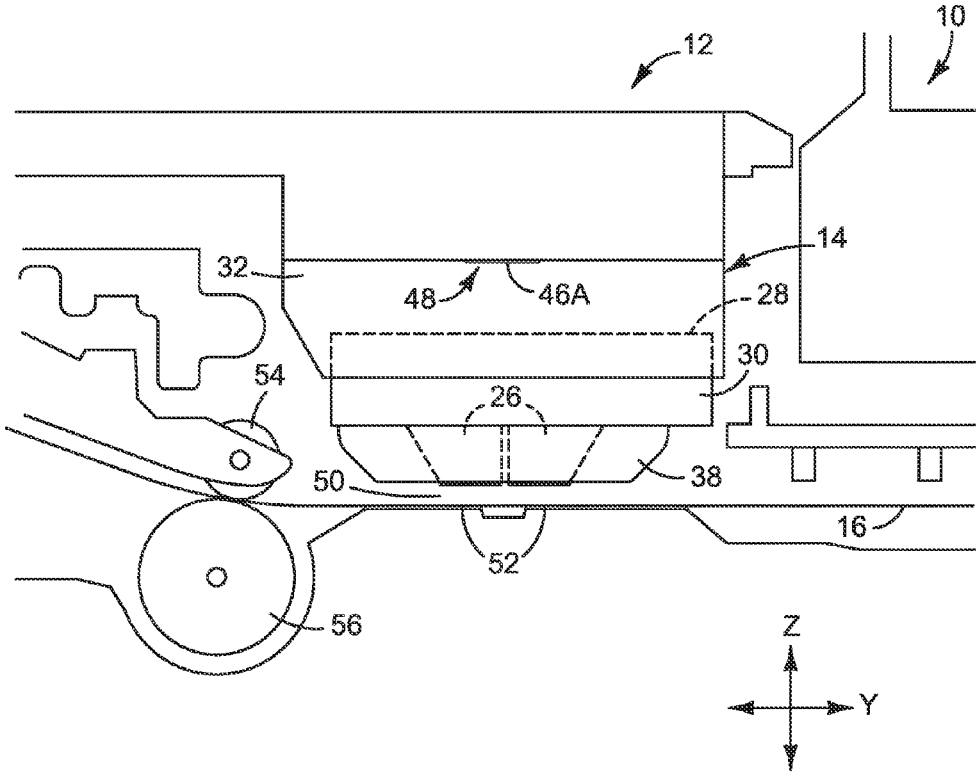
FIG. 4 is an end view illustrating the print bar of FIG. 3 installed in a printer showing the primary, Z direction spacing between the printheads and the print media.

FIG. 1 is a block diagram illustrating an inkjet printer 10 with a print bar 12 implementing one example of a new print bar structure 14 in which a flat rigid flange on the chassis helps control the position and alignment of the ink manifold and the printhead mounting substrate. FIG. 2 is a diagrammatic partial section view illustrating a print bar structure 14 such as the one shown in the block diagram of FIG. 1. FIG. 3 is an end view of a print bar 12 implementing the print bar structure 14 shown in FIG. 2. FIG. 4 illustrates print bar 12 installed in a printer showing the primary, Z direction spacing between the printheads and the print media.

Referring first to FIG. 1, printer 10 includes print bar 12 spanning the width of a print media 16, flow regulators 18 associated with print bar 12, a media transport mechanism 20, ink supplies 22, and a printer controller 24. Print bar 12 in FIG. 1 includes an arrangement of multiple printheads 26 for ejecting ink or other printing fluid on to a sheet or continuous web of paper or other print media 16. Each printhead 26 is electrically connected to printer controller 24 and fluidically connected to one or more ink supplies 22 through flow regulators 18 and a typically complex ink flow path in print bar 12 that includes an ink manifold 28 and a printhead mounting substrate 30. Controller 24 in FIG. 1 represents generally the programming, processor(s) and associated memories, and the electronic circuitry and components needed to control the operative elements of a printer 10. In operation, printer controller 24 selectively energizes ink ejector elements in a printhead 26, or group of printheads 26, in the appropriate sequence to eject ink on to media 16 in a pattern corresponding to the desired printed image.

Referring now also to FIGS. 2-4, print bar structure 14 includes a chassis 32 supporting ink manifold 28 and printhead mounting substrate 30. Ink flows to printheads 26 from ink supplies 22 and flow regulators 18 through manifold 28 and substrate 30, as indicated generally by a simplified flow path 34 and openings 36 in FIG. 2. A shroud 38 extends along the bottom of print bar 12, covering exposed portions of substrate 30 and printheads 26 while leaving the face of each printhead 26 exposed for jetting ink. As described in detail below with reference to FIGS. 5-11, manifold 28 and mounting substrate 30 are assembled against a flat rigid flange 40 on print bar chassis 32. The front and rear faces 42, 44 of flange 40 lie in planes parallel to a plane defined by reference surfaces 46A, 46B, 46C on chassis 32. Reference surfaces 46A, 46B, 46C establish three points of contact for mounting print bar 12 in printer 10 that form a primary, Z datum 48 to help maintain the desired spacing between printheads 26 and print media 16 during printing.

Referring specifically to FIG. 4, print media 16 is moved through a print zone 50 between printheads 26 and a platen 52 at the urging of media transport rollers 54, 56. Z datum contact surfaces 46A-46C abut mating surfaces on the printer chassis (not shown) to establish the correct Z direction spacing between printheads 26 and platen 52 when print bar 12 is installed in printer 10, and thus help establish the correct spacing between printheads 26 and print media 16 during printing. Six points of contact may be used to correctly position and fully constrain print bar 12 in all six degrees of freedom of motion. For example, as described below with reference to FIGS. 5-11, three points of contact 46A, 46B and 46C form a primary, Z datum 48 (FIGS. 5 and 6), two points contact 58A, 58B form a secondary, Y datum 60 (FIG. 5), and one point of contact 62 forms a tertiary, X datum 64 (FIG. 5). The three primary, Z datum contact points 46A-46C stop translation in the Z direction and rotation about the X and Y axes. The two secondary, Y datum points 58A and 58B stop translation in the Y direction and rotation about the Z axis. The single tertiary, X datum contact point 62 stops translation in the X direction.

Referring now to the example of print bar 12 shown in FIGS. 5-11, printhead mounting substrate 30 includes ink slots 66 that carry ink to each printhead 26 from a corresponding set of ink ports 68 in manifold 28, as best seen in the section view of FIG. 11. (Section lines 10-10 and 11-11 in FIG. 8 indicate the location of the sections of print bar substrate 12 shown in FIGS. 10 and 11, respectively.) Each set of ink slots 66 is surrounded by a mounting surface 70 on the front face 72 of substrate 30 for mounting printheads 26. Manifold 28 and substrate 30 are joined to one another along surface(s) 74 on the front face 76 of manifold 28 and corresponding surface(s) 78 on the rear face 80 of substrate 30. To help develop high quality personal and small business printers at an affordable price, it is often desirable or even necessary to use molded plastic parts, particularly for ink flow components with complex shapes like manifold 28, substrate 30 and parts of printheads 26. Accordingly, printheads 26 and manifold 28 are usually glued or welded to the respective substrate face 72, 80. The close spacing between ink slots 66, however, means substrate 30 and manifold 28 must be kept very flat during assembly to minimize the amount of adhesive or energy needed to join the parts. More adhesive to accommodate gluing non-flat parts increases the risk adhesive will flow into and obstruct an ink slot. Similarly, more energy to accommodate welding non-flat parts increases the risk softened plastic will flow into and obstruct an ink slot. However, it is difficult to consistently mold flat long, narrow plastic parts, like manifold 28 and substrate 30, that hold their shape after being released from the mold.

To overcome this difficulty, flat reference surfaces 82, 84 are formed on a metal or other suitably rigid chassis 32. For example, machining datum contact pads 62, 58A-58B, and 46A-46C and reference surfaces 82, 84 on to a cast aluminum chassis 32 enables consistently manufacturing suitably flat print bar structures 14. X, Y, and Z datum contact pads 62, 58A-58B, and 46A-46C are machined flat on chassis 32 after casting to define X datum 64, Y datum 60, and Z datum 48. Reference surfaces 82 and 84 are machined on to flange 40 in X-Y planes parallel to the X-Y plane defined by primary Z datum 48. Chassis flange 40 surrounds an opening 86. In the example shown, flange 40 completely surrounds opening 86. Other configurations are possible. For example, it may be desirable in some implementations to utilize a discontinuous flange 40 that only partially surrounds opening 86. In either case, one or both of manifold front face 76 and substrate rear face 80 extend into or through chassis opening 85. In the example shown, as best seen in FIG. 11, the front face 76 of manifold 28 extends into chassis opening 86.

During assembly, an alignment surface 88 on the rear face 80 of mounting substrate 30 is forced against chassis reference surface 82 and an alignment surface 90 on the front face 76 of manifold 28 is forced against chassis reference surface 84. Forcing substrate 30 and manifold 28 against the flat chassis reference surfaces 82, 84 eliminates warp and establishes a uniform gap 92 between the attachment surfaces 94, 96 on the two parts 28, 30. For a glue joint 98, adhesive is used to fill gap 92 to join the two plastic parts 28, 30. For a weld joint 98, plastic flows into gap 92 to join the two parts 28, 30. The biasing force on the plastic parts 28, 30 is maintained until the adhesive cures or until the weld is completed. Once joint 98 is secure, printhead mounting substrate 30 maintains contact with chassis reference surface 82 so that the printhead mounting surfaces 70 on substrate 30 are flatter and more parallel to primary, Z datum 48 than is possible without the "backbone" provided by chassis 32. (The relationship between chassis flange 40, opening 86, alignment surfaces 88, 90, attachment surfaces 94, 96, and joint 98 is also shown in the simplified, diagrammatic view of FIG. 2.)

A second difficulty constructing a media wide print bar 12 is enabling print bar structure 14 to withstand the dimensional changes that occur as manifold 28, substrate 30, and chassis 32 expand and contract during temperature fluctuations. The stresses associated with dimensional changes in the parts can result in joint failure or permanent dimensional changes that compromise print quality. Examples of the new print bar structure 14 include features that help the structure withstand the stresses of dimensional change without damaging the print bar. To minimize tolerances and improve part-to-part alignment, as described in detail below, the alignment features for both manifold 28 and mounting substrate 30 are located directly adjacent to one another on chassis 32. Also, manifold 28 and substrate 30 are molded from the same plastic to have substantially the same coefficient of thermal expansion (CTE). While the CTE of a plastic manifold 28 and substrate 30 is different from the CTE of chassis 32, and chassis 32 will expand or contract differently than manifold 28 and substrate 30, manifold 28 and substrate 30 are joined to one another but not to chassis 32. Thus, the parts with different CTEs can move relative to one another in the XY plane along chassis flange 40. Allowing the parts to move in the XY plane helps relieve dimensional change stresses without changing the position of substrate 30 (and thus printheads 26) with respect to the primary, Z datum 48.

Referring to FIGS. 6-11, printhead mounting substrate 30 extends lengthwise in the X direction. Two alignment slots 110 are located on opposite ends of chassis 32 in the X direction. Corresponding pins 112 at each end of mounting substrate 30 fit tightly in chassis alignment slots 110 in the Y direction (across the width of slots 110) and loosely in the X direction (along the length of slots 110). Pins 112 are located at the mid-point of substrate 30 in the Y direction—the neutral point from which expansion and contraction in the Y direction will occur in substrate 30. The tight fit of pins 112 across the width of slots 110 constrains mounting substrate 30 in the Y direction while the loose fit along the length of slots 110 allows substrate 30 to move in the X direction during expansion or contraction. A third alignment slot/pin pair 114, 116 is located at the mid-point of mounting substrate 30 in the X direction—the neutral point from which expansion and contraction in the X direction will occur in substrate 30. The tight fit of pin 116 across the width of slot 114 constrains mounting substrate 30 in the X direction while the loose fit along the length of slot 114 allows substrate 30 to move in the Y direction during expansion or contraction.

The slot/pin pair interfaces form a slip joint 118 between printhead mounting substrate 30 and chassis 32 that helps control part-to-part alignment during heating and cooling. Although the part-to-part alignment will change during heating and cooling, slip joint 118 created by the pin/slot interface helps determine how the alignment changes—the slot acts like a track for the pin to follow in the event of a dimensional change during a thermal event. As long as there is contact between the pin and the slot, the path the parts take during expansion (heating) should be the same as the path they take during contraction (cooling). Thus, the parts should return to the same place they were before the thermal event occurred.

A slip joint 120 between ink manifold 28 and chassis 32 is achieved in the same way, but the alignment features are reversed. Alignment slots 122, 124 in manifold 28 fit on corresponding pins 126, 128 on chassis 32. In the example shown, each chassis pin 126, 128 is configured as a continuation of the sidewalls 130 that define chassis slots 110 and 114. This configuration, in which the substrate/chassis and manifold/chassis slip joints are positioned back-to-back, allows forming the plastic joint features by the same side of the mold, reducing positional tolerances and improving alignment between substrate ink slots 66 and manifold ink ports 68. Better alignment, in turn, helps minimize the risk of ink slot/port obstruction during gluing or welding.

As noted above, the CTEs of plastic parts 28, 30 and a metal chassis 32 are not the same. Upon heating or cooling the plastic manifold 28 and substrate 30, which are affixed to one another, will expand or contract about the same but differently than chassis 32. Allowing the parts to slip in the X and Y direction at joints 118 and 120 helps keep the parts from loosening in the Z direction by reducing joint stress during thermal events. Slip joints 118 and 120 allow the parts to expand or contract in the XY plane, minimizing bowing and other distortion in the Z direction. Maintaining a tight fit in the Z direction is desirable because the alignment of printheads 26 to the primary, Z datum helps define the spacing between printheads 26 and print media 16 in print zone 50 during printing (FIG. 4)—properly controlling the printhead-to-media spacing is important to good quality printing.

Reversing the male/female relationship between the parts in slip joints 118 and 120 in print bar structure 114 also helps control part-to-part alignment during both heating and cooling. The pins track in the slots during expansion and contraction. To avoid sloppy tracking, the pins should stay tight in the slots during heating and cooling. This is achieved by reversing the male/female relationship based on the CTEs of the two materials—for example an aluminum chassis 32 with a larger CTE and a plastic manifold 28 and printhead mounting substrate 30 with a smaller CTE. During heating, when the parts expand, the male features on substrate 30 (pins 112, 116) get a little bigger while the female features on chassis 32 (slots 110, 110) get a lot bigger, creating unwanted slop and loosening at slip joint 118. However, the male features on chassis 32 (pins 126, 128) get a lot bigger while the female features on manifold 28 (slots 122, 124) only get a little bigger, tightening slip joint 120. Manifold 28 and substrate 30 are affixed to one other and, consequently, the still tight slip joint 120 maintains control during heating. During cooling, when the parts contract, slip joint 120 may loosen but slip joint 118 will tighten. Thus, by reversing the male/female relationship of the slip joints, one of the two slip joints should remain tight to maintain control during both heating and cooling.

"A" and "an" as used in the claims means one or more.

The examples shown in the Figures and described above illustrate but do not limit the invention. Other forms, details and examples may be made without departing from the spirit and scope of the invention which is defined in the following claims.

What is claimed is:

1. A print bar structure, comprising:

a planar, rigid first part;

an elongated second part having a front face on which one or more printheads are to be mounted and a rear face opposite the front face;

an elongated third part having a front face; and the second part and the third part are affixed to one another but not to the first part with the first part disposed between the rear face of the second part and the front face of the third part such that the rear face of the second part and the front face of the third part conform to the first part.

2. The print bar structure of claim 1, wherein the rear face of the second part includes a first alignment surface at least partially surrounding a first attachment surface;

the front face of the third part includes a second alignment surface at least partially surrounding a second attachment surface; and the second part and the third part are affixed to one another at the first and second attachment surfaces with the first part disposed between the first and second alignment surfaces.

3. The print bar structure of claim 2, wherein the first part disposed between the first and second alignment surfaces establish a gap between the first attachment surface of the second part and the second attachment surface of the third part.

4. The print bar structure of claim 2, wherein the first part at least partially surrounds an opening, the second attachment surface of the third part extends at least one of into or through the opening.

5. The print bar structure of claim 4, wherein:

the first part completely surrounds the opening;

the first alignment surface of the second part completely surrounds the first attachment surface of the second part; and the second alignment surface of the third part completely surrounds the second attachment surface of the third part.

6. The print bar structure of claim 1, wherein the third part is to carry printing fluid to the second part.

7. The print bar structure of claim 1, wherein the first part comprises a rigid chassis having a datum defining an XY plane perpendicular to a Z direction, a flat front reference surface parallel to the XY plane on a first side of the chassis, and a flat rear reference surface parallel to the XY plane on a second side of the chassis opposite the first side;

the second part comprises a printhead mounting substrate;

the third part comprises a manifold to carry printing fluid to the printhead mounting substrate;

a first portion of the rear face of the printhead mounting substrate is affixed to a first portion of the front face of the manifold such that the printhead mounting substrate and the manifold are fixed relative to one another; and a second portion of the rear face of the printhead mounting substrate is joined to the front reference surface of the chassis at a first slip joint that constrains movement of the printhead mounting substrate in the Z direction but enables the printhead mounting substrate to slip in an X direction and a Y direction.

8. The print bar structure of claim 7, wherein a second portion of the front face of the manifold is joined to the rear reference surface of the chassis at a second slip joint that constrains movement of the manifold in the Z direction but enables the manifold to slip in the X and Y directions.

9. The print bar structure of claim 7, wherein the chassis is made of a material having a first coefficient of thermal expansion and the printhead mounting substrate and the manifold are made of a material having a second coefficient of thermal expansion different from the first coefficient of thermal expansion.

10. The print bar structure of claim 7, wherein the first slip joint comprises slots in the chassis and pins on the printhead mounting substrate, the pins are respectively fitted in a corresponding one of the slots such that the pins are constrained in one of the X direction or the Y direction.

11. The print bar structure of claim 8, wherein:

the first slip joint comprises first slots in the chassis and first pins on the printhead mounting substrate, the first pins are respectively fitted in a corresponding one of the first slots such that the first pins are constrained in one of the X direction or the Y direction; and the second slip joint comprises second slots in the manifold and second pins on the chassis, the second pins are respectively fitted in a corresponding one of the second slots such that the second pins are constrained in one of the X direction or the Y direction.

12. The print bar structure of claim 11, wherein each first pins on the chassis is positioned in the XY plane at the same position as the corresponding one of the first slots in the chassis.

13. The print bar structure of claim 9, wherein the chassis comprises metal and, the printhead mounting substrate and the manifold comprise plastic.

14. The print bar structure of claim 7, wherein the printhead mounting substrate comprises a flat rigid backbone and the manifold comprises an ink manifold.

15. The print bar structure of claim 14, wherein the backbone comprises a metal flange disposed between the printhead mounting substrate and the ink manifold.

* * * * *